US006417467B1

(12) United States Patent
Yamagata

(10) Patent No.: US 6,417,467 B1
(45) Date of Patent: Jul. 9, 2002

(54) SHEET WITH MOVABLE CONTACTS AND SHEET SWITCH

(76) Inventor: Takeo Yamagata, c/o Alps Electric Co., Ltd. 1-7 Yukigaya, Otsuka-cho, Ota-ku, Tokyo (JP)

( * ) Notice: Subject to any disclaimer, the term of this patent is extended or adjusted under 35 U.S.C. 154(b) by 0 days.

(21) Appl. No.: 09/604,223

(22) Filed: Jun. 27, 2000

(30) Foreign Application Priority Data

Jun. 29, 1999 (JP) ..... 11-183236

(51) Int. Cl.[7] ..... H01H 9/26
(52) U.S. Cl. ..... 200/5 A; 200/512
(58) Field of Search ..... 200/5 A, 512, 200/314, 341, 515, 514, 516; 29/622

(56) References Cited

U.S. PATENT DOCUMENTS 4,367,385 A * 1/1983 Frame ..... 200/159 B
4,375,018 A * 2/1983 Petersen ..... 200/5 A
4,684,767 A * 8/1987 Phalen ..... 200/5 A
4,771,139 A * 9/1988 DeSmet ..... 200/5 A
5,399,823 A * 3/1995 McCusker ..... 200/521
5,845,766 A 12/1998 Sako et al.
5,924,555 A 7/1999 Sadamori et al.

FOREIGN PATENT DOCUMENTS

EP 322515 * 9/1988

* cited by examiner

*Primary Examiner*—Renee Luebke
*Assistant Examiner*—Lisa N. Klaus
(74) *Attorney, Agent, or Firm*—Brinks Hofer Gilson & Lione

(57) ABSTRACT

The sheet with movable contacts comprises a first sheet formed by an insulating film, the first sheet having an adhesive surface formed by applying an adhesive to a lower surface of the first sheet, a plurality of domed, metallic, movable contacts whose upper surfaces are covered with and affixed to the adhesive surface of the first sheet, and a second sheet formed by an insulating film, the second sheet being affixed to the lower surface of the first sheet and having a plurality of receptacle holes for receiving the movable contacts therein, with an adhesive being applied to a lower surface of the second sheet, wherein the second sheet has connecting slots formed therein for connecting adjacent such receptacle holes with each other.

2 Claims, 4 Drawing Sheets

SHEET WITH MOVABLE CONTACTS AND SHEET SWITCH

BACKGROUND OF THE INVENTION

1. Field of the Invention

The present invention relates to a sheet with movable contacts and a sheet switch using the same, which are for use in operating panels of various electronic devices for example.

2. Description of the Related Art

A conventional structure of a sheet with movable contacts and that of a sheet switch are shown in FIGS. 5 to 8, of which FIG. 5 is an exploded perspective view of the sheet with movable contacts, FIG. 6 is a sectional view thereof, FIG. 7 is an exploded perspective view of the sheet switch, and FIG. 8 is a sectional view thereof.

In those figures, the sheet with movable contacts is made up of movable contacts 23 formed in a dome shape using metal, a sheet 21 formed by an insulating film, the sheet 21 covering upper surfaces of the movable contacts 23 and having an adhesive 22 applied to a lower surface thereof, and a separator sheet 24 affixed to the lower surface of the sheet 21 to close lower surfaces of the movable contacts 23, the separator sheet 24 being formed by paper or an insulating film.

The domed upper surfaces of the movable contacts 23 are covered with and fixed to the adhesive 22 which is applied to the lower surface of the sheet 21. The separator sheet 24 affixed to the lower surface of the sheet 21 is for preventing corrosion of the movable contacts 23 caused by gases contained in air or for preventing the adhesion of foreign matters to the movable contacts, during storage or transport of the sheet. The separator 24 can be peeled off.

The sheet switch is made up of the above sheet with movable contacts and a circuit board 28 provided on an upper surface thereof with central fixed contacts 30 and outer fixed contacts 29. In a removed state of the separator sheet 24 from the sheet with movable contacts, the movable contacts 23 are affixed onto the circuit board 28 using the adhesive applied to the lower surface of the sheet 21 in such a manner that lower ends of outer peripheries of the movable contacts 23 are respectively brought into abutment with the outer fixed contacts 29 and that central portions thereof are opposed to the central fixed contacts 30.

In the above structure of the sheet switch, when an operating portion 31*a* of a rubbery or resinous push-button 31 disposed above the sheet switch is depressed, the associated movable contact 23 is depressed by a depressing portion 31*b* formed on a lower surface of the operating portion 31*a* and is inverted, so that its central portion comes into abutment against the associated central fixed contact 30 on the circuit board 28, whereby the central fixed contact 30 and the associated outer fixed contact 29 on the circuit board are electrically connected with each other. Upon release of the depressing force imposed on the push-button 31, the central portion of the movable contact 23 is disconnected from the central fixed contact 30 with an elastic restoring force of the movable contact.

In the above conventional structures of the sheet with movable contacts and the sheet switch, however, the movable contacts 23 are covered with and fixed to a single sheet 21 of an insulating film with the adhesive 22 applied to the lower surface of the sheet, so when the sheet with movable contacts is affixed onto the circuit board 28 and when any of the domed movable contacts 23 located near the outer periphery of the sheet 21 is depressed, the air present within the dome of the movable contact is forced out and causes an end portion of the sheet to float, thus giving rise to the problem that dust enters through the floating end portion and causes an incomplete state of contact.

Moreover, the portions of the sheet 21 which surround the domed movable contacts 23 are fixed with the adhesive 22, so when any of the movable contacts 23 is depressed, the air present within the dome of the depressed movable contact cannot escape anywhere, thus giving rise to the problem that the operation feeling is deteriorated.

SUMMARY OF THE INVENTION

Accordingly, it is an object of the present invention to solve the above-mentioned problems and provide a structure of a sheet with movable contacts and a structure of a sheet switch using the sheet which, even when a movable contact located near an outer periphery of the sheet is depressed, can prevent floating of the sheet and can thereby prevent the entry of dust, thus affording a high contact reliability, and which can afford a good operation feeling at the time of operation and a superior adhesion between the movable contacts and a sheet member applied over the movable contacts.

For solving the above-mentioned problems, according to one aspect of the present invention, there is provided a sheet with movable contacts, comprising a first sheet formed by an insulating film, the first sheet having an adhesive surface formed by applying an adhesive to a lower surface of the first sheet, a plurality of domed, metallic, movable contacts whose upper surfaces are covered with and affixed to the adhesive surface of the first sheet, and a second sheet formed by an insulating film, the second sheet being affixed to the lower surface of the first sheet and having a plurality of receptacle holes for receiving the movable contacts therein, with an adhesive being applied to a lower surface of the second sheet, wherein the second sheet has connecting slots formed therein for connecting adjacent such receptacle holes with each other.

In another aspect of the present invention, a separator sheet whose upper surface has been subjected to a release treatment is affixed to the lower surface of the second sheet so as to be releasable from the second sheet.

In a further aspect of the present invention, through holes are formed in the separator sheet opposedly to the plural receptacle holes formed in the second sheet, and a protective sheet is affixed to a lower surface of the separator sheet to close the through holes.

In a still further aspect of the present invention there is provided a sheet switch comprising the sheet with movable contacts first referred to above and a circuit board having a plurality of fixed contacts, wherein, with the movable contacts arranged opposedly to the fixed contacts, the sheet with movable contacts is affixed onto the circuit board with the adhesive applied to the lower surface of the second sheet.

DETAILED DESCRIPTION OF A PREFERRED EMBODIMENT

Figure 1:
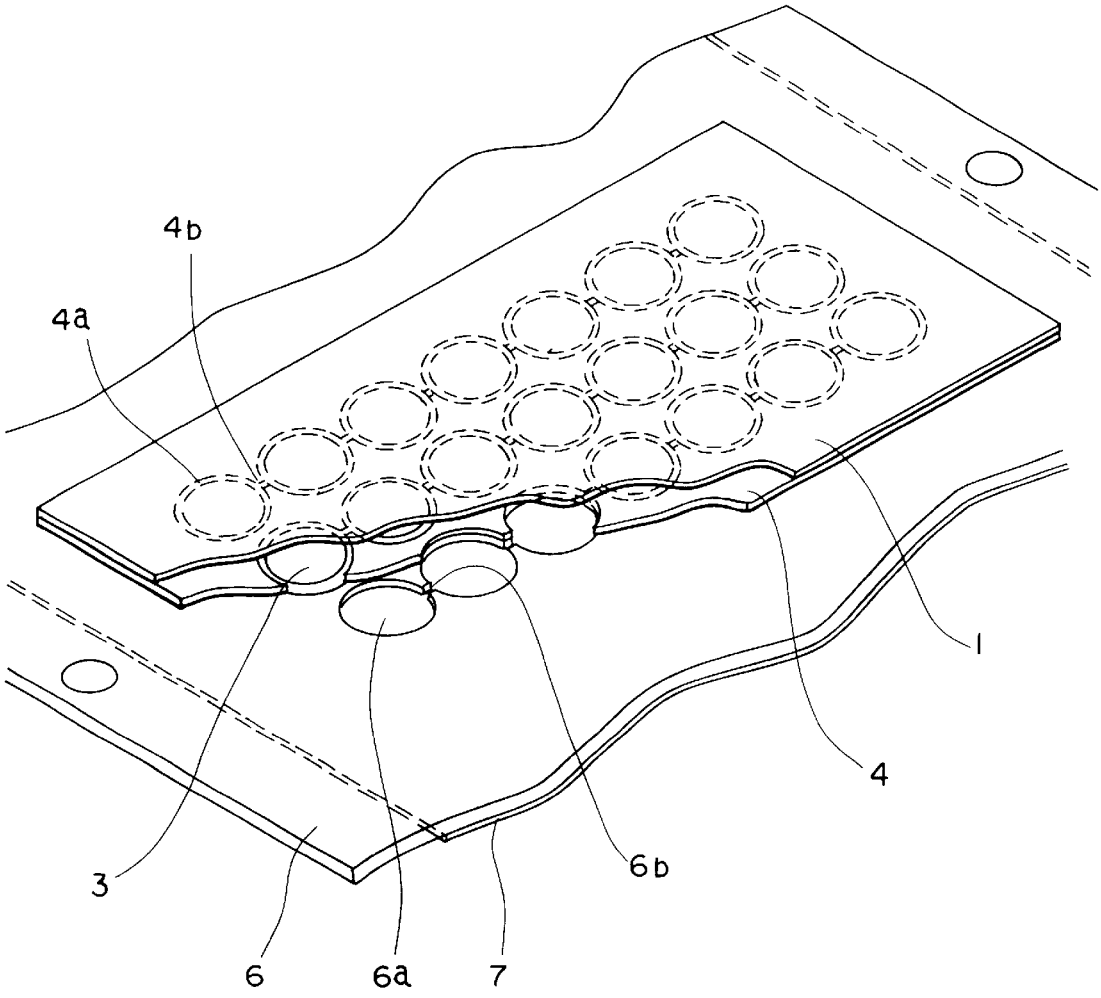
FIG. 1 is a partially cut-away perspective view showing a sheet with movable contacts according to the present invention.
Figure 2:
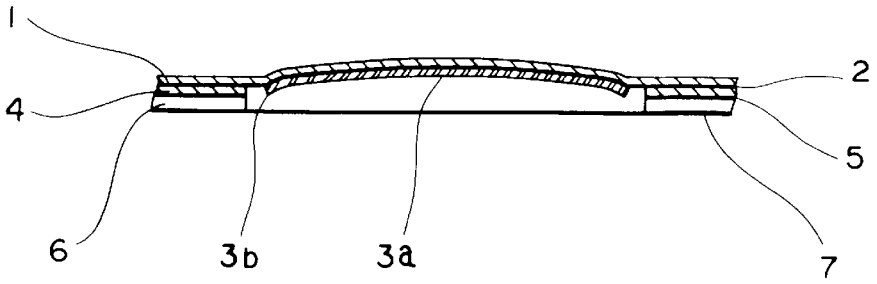
FIG. 2 is a sectional view showing a movable contact portion of the sheet.

An embodiment of the present invention will be described in detail hereinunder with reference to FIGS. 1 to 4. FIGS. 1 and 2 show a structure of a sheet with movable contacts embodying the present invention, of which FIG. 1 is a partially cut-away perspective view of the sheet and FIG. 2 is a sectional view of a movable contact portion.

In FIGS. 1 and 2, a first sheet 1 is formed by a film of an insulating material such as a synthetic resin, e.g. PET (polyethylene terephthalate), with an adhesive 2 being applied throughout a lower surface of the first sheet 1 to form an adhesive surface.

Movable contacts 3 are each formed in the shape of a dome having a central portion 3a with use of a resilient metallic material such as stainless steel or phosphor bronze. The central portion 3a is inverted to the opposite side when depressed with an external force.

A second sheet 4, like the first sheet 1, is also formed by a film of an insulating material such as a synthetic resin, e.g. PET (polyethylene terephthalate). Also throughout a lower surface of the second sheet 4 is applied an adhesive 5 to form an adhesive surface. In the second sheet 4 are formed a plurality of circular receptacle holes 4*a* for receiving the movable contacts 3 therein. The receptacle holes 4*a* are formed with connecting slots 4*b* for connecting adjacent receptacle holes 4*a* with each other.

A separator sheet 6 is formed by a film of an insulating material such as paper or a synthetic resin. An upper surface of the separator sheet 6 has been subjected to a release treatment so as to be releasable from the adhesive surface formed on the second sheet 4 using the adhesive 5. As in the second sheet 4, a plurality of circular through holes 6*a* are formed in the separator sheet 6, with connecting slots 6*b* being formed in the through holes 6*a* for connecting adjacent through holes 6*a* with each other.

A protective sheet 7 is formed by an insulating film having an adhesive upper surface and is affixed to a lower surface of the separator sheet 6 so as to close the plural through holes 6*a*.

The sheet with movable contacts constructed as above is assembled in the following manner. First, the adhesive surface of the adhesive 5 applied to the lower surface of the second sheet 4 is registered with the upper surface of the separator sheet 6 and in this state the second sheet is affixed to the separator sheet upper surface. Next, in the thus-laminated sheets are formed the receptacle holes 4a, through holes 6*a*, and connecting slots 4*b*, 6*b* in plural positions as necessary. In this case, the receptacle holes 4*a*, through holes 6*a*, and connecting slots 4*b*, 6*b* formed in the second sheet 4 and separator sheet 6 are of the same shape because they are formed at a time using a single punch.

Next, the adhesive surface of the adhesive 2 applied to the lower surface of the first sheet 1 is registered with the upper surface of the second sheet 4 and in this state the first sheet is affixed to the second sheet upper surface. The movable contacts 3 are inserted through the plural through holes 6*a* from the underside of the separator sheet 6 and the domed upper surfaces thereof are affixed to the adhesive surface of the adhesive 2 applied to the lower surface of the first sheet 1. In this state the movable contacts are received respectively in the receptacle holes 4*a* of the second sheet 4. Lastly, the adhesive upper surface of the protective sheet 7 is registered with and affixed to the lower surface of the separator sheet 6 to complete the assembly.

In the above assembling process for the sheet with movable contacts embodying the invention, the adhesive surfaces of the adhesives 2 and 5 applied to the first and second sheets 1, 4, respectively, are not exposed to the exterior when affixing the movable contacts 3 to the first sheet 1, so there is no fear of adhesion of dust or the like to the adhesive surfaces and thus the occurrence of an incomplete state of contact can be prevented.

Figure 3:
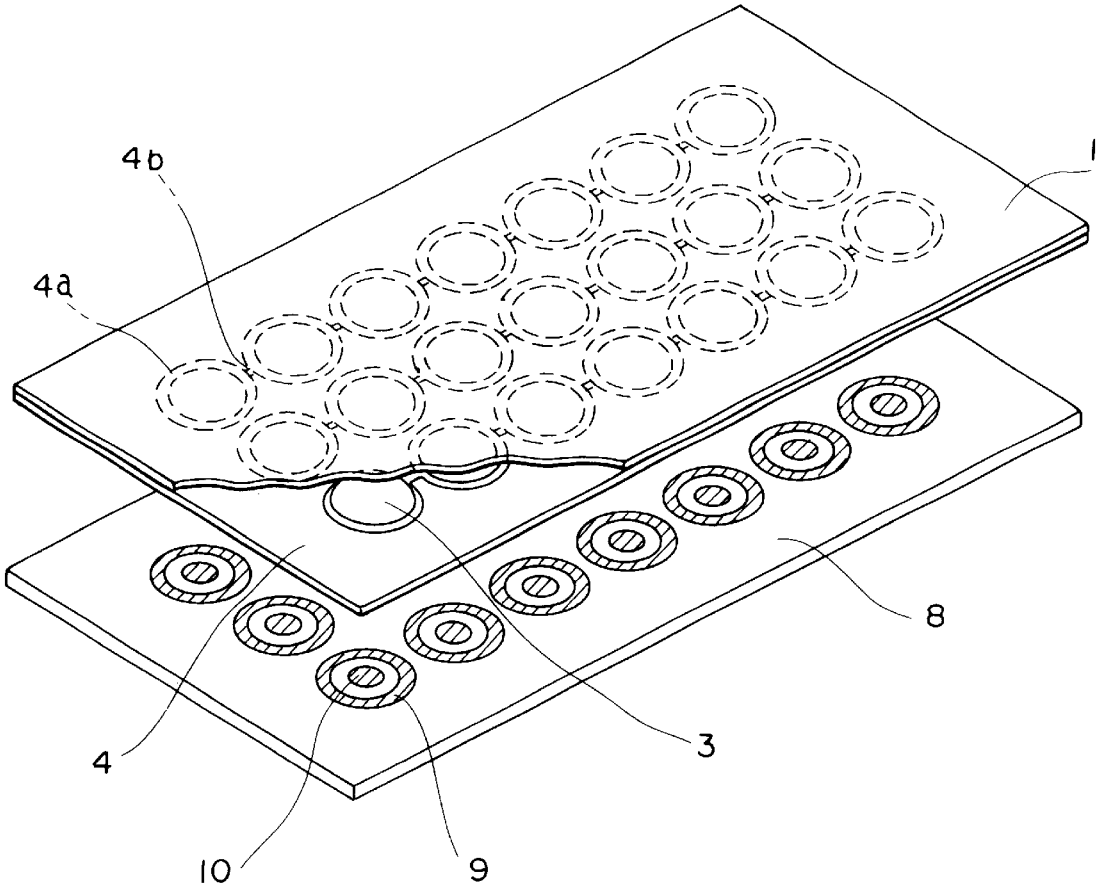
FIG. 3 is a partially cut-away exploded perspective view showing a sheet switch using the sheet with movable contacts.
Figure 4:
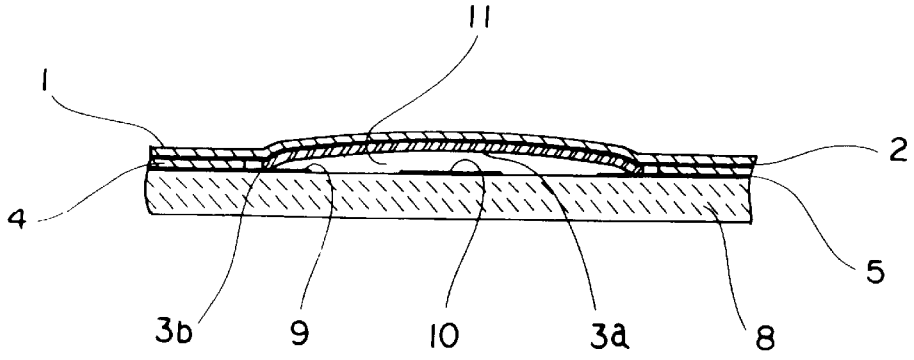
FIG. 4 is a sectional view showing a movable contact portion and a fixed contact portion of the sheet switch.
Figure 5:
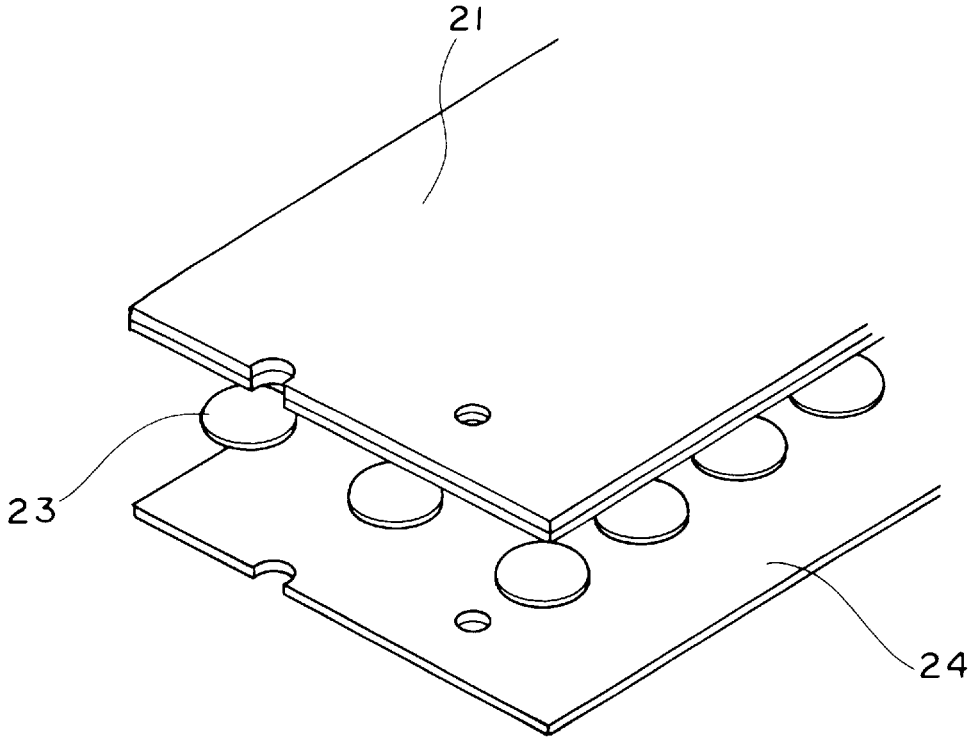
FIG. 5 PRIOR ART
FIG. 5 is an exploded perspective view showing a conventional sheet with movable contacts.
Figure 6:
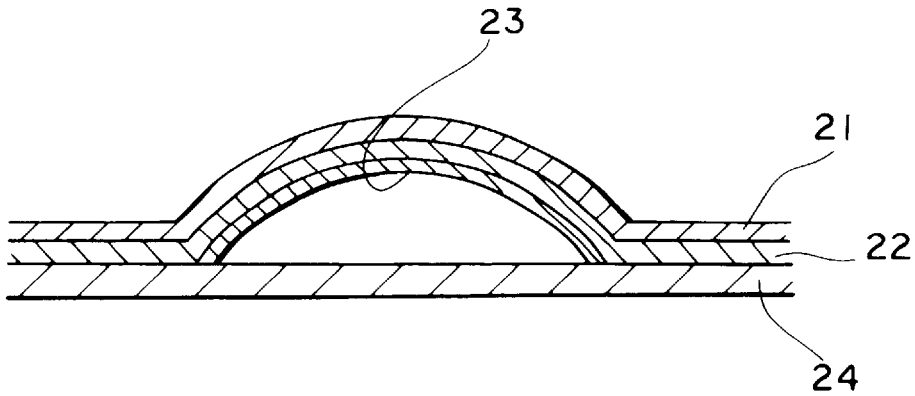
FIG. 6 PRIOR ART
FIG. 6 is a sectional view thereof.
Figure 7:
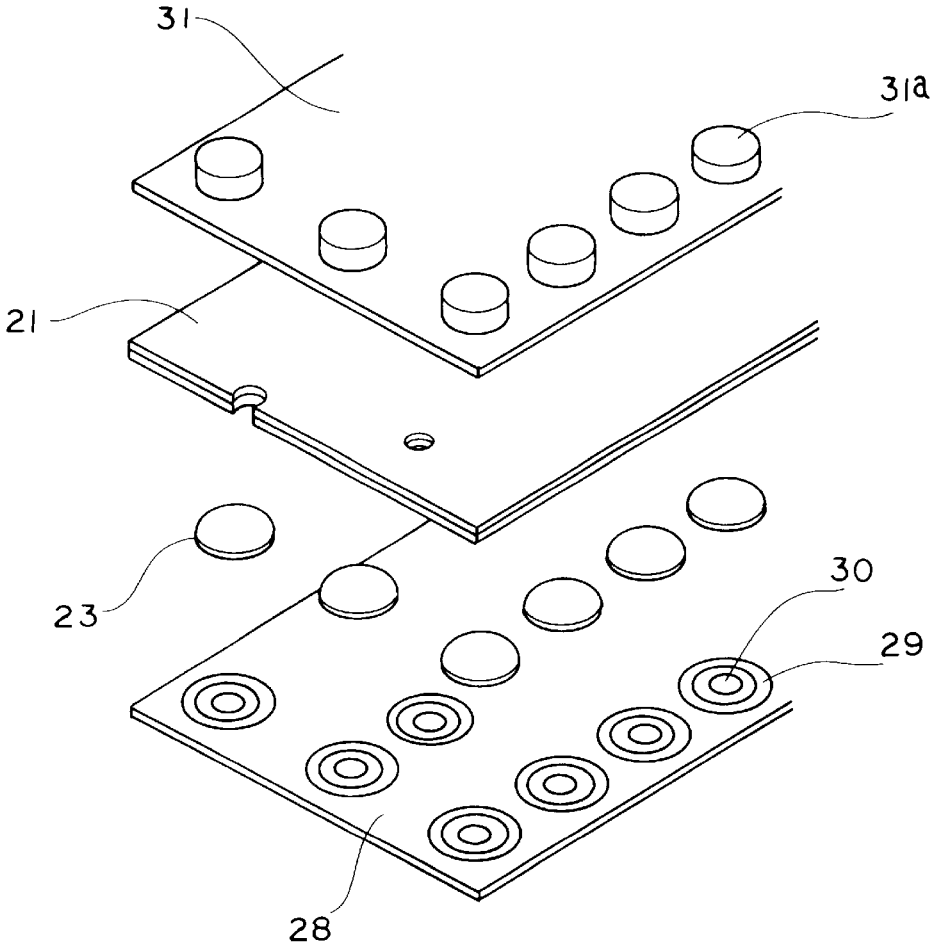
FIG. 7 PRIOR ART
FIG. 7 is an exploded perspective view showing a conventional sheet switch.
Figure 8:
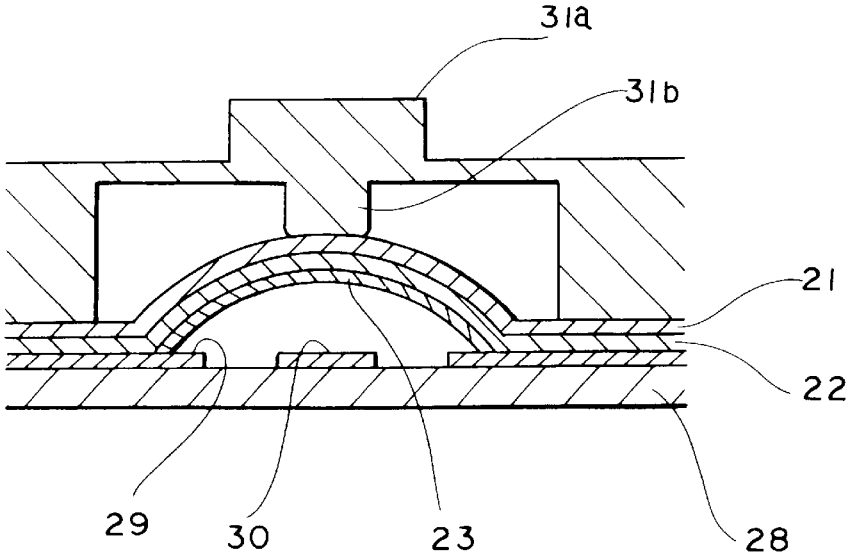
FIG. 8 PRIOR ART
FIG. 8 is a sectional view thereof.

FIGS. 3 and 4 show a structure of a sheet switch using the sheet with movable contacts according to the present invention, of which FIG. 3 is a partially cut-away exploded perspective view of the sheet switch and FIG. 4 is a sectional view of a movable contact portion and a fixed contact portion. In both figures, the same components as in FIGS. 1 and 2 are identified by the same reference numerals as in FIGS. 1 and 2 and explanations thereof will here be omitted.

In FIGS. 3 and 4, a circuit board 8 is formed, for example, by an insulating laminate such as a phenolic resin laminate. On the circuit board 8 are formed a plurality of circuit patterns of outer fixed contacts 9 and central fixed contacts 10 by, for example, printing carbon or etching copper foil.

The sheet switch is assembled in the following manner. The separator sheet 6 is peeled off from the sheet with movable contacts, for example, by pulling it with hands. Thereafter, the sheet with movable contacts is positioned onto the circuit board 8 and the movable contacts, whose upper surfaces are affixed to the first sheet 1 and which are received in the receptacle holes 4*a*, are affixed onto the circuit board 8 through the adhesive surface of the adhesive 5 applied to the lower surface of the second sheet 4 in such a manner that lower ends 3*b* of outer peripheries of the movable contacts 3 are abutted against the outer fixed contacts 9 and that the central portions 3*a* of the movable contacts are opposed to the central fixed contacts 10. The assembly is now over.

The operation of the sheet switch thus constructed will now be described. When an operating portion of any of rubbery or resinous push-buttons (not shown) disposed above the sheet switch is depressed, the associated movable contact 3 is depressed through the first sheet 1 and is inverted thereby, with the result that its central portion 3*a* comes into abutment against the associated central fixed contact 10, whereby the central fixed contact is electrically connected with the associated outer fixed contact 9. Upon release of the depressing force imposed on the push-button, the central portion 3*a* of the movable contact 3 is disconnected from the central fixed contact 10 with an elastic restoring force of the movable contact 3.

In the above structure of the sheet switch according to the present invention, a plurality of circular receptacle holes 4a for receiving the movable contacts 3 therein are formed in the second sheet 4 and connecting slots 4*b* for connecting adjacent receptacle holes 4*a* with each other are formed in the receptacle holes 4*a*, so when any of the movable contacts 3 is depressed through the first sheet 1, air 11 present in the dome of the movable contact 3 which is dome-shaped is conducted to the next receptacle hole 4a through the connecting slot 4*b* located therebetween. Therefore, also when any of the movable contacts 3 located near an outer peripheral portion of the first sheet 1 is depressed, the air 11 present in the dome of the movable contact is forced out, thus preventing an end portion of the first sheet 1 from being floated by the air, whereby it is possible to prevent the entry of dust from the sheet end portion which would cause an incomplete state of contact.

Besides, when any of the movable contacts 3 is depressed, an escape place for the air 11 present in the dome of the domed movable contact is ensured in adjacent receptacle holes 4*a* formed in the second sheet 4, so that the movable contact 3 can surely be inverted within the associated receptacle hole 4a, thus affording a good operation feeling.

As set forth above, in the structure of the sheet with movable contacts according to the present invention, since the second sheet having plural receptacle holes for receiving domed movable contacts therein is affixed to the lower surface of the first sheet and is formed with connecting slots for connecting adjacent receptacle holes with each other, the air present in the dome of each domed movable contact can pass through the associated connecting slot and escape to the next receptacle hole, thus ensuring an inverting motion of the movable contact within the receptacle hole and affording a good operation feeling.

Moreover, since the separator sheet whose upper surface has been subjected to a release treatment is affixed to the lower surface of the second sheet so as to be releasable from the second sheet, the adhesive surfaces of adhesives applied to the first and second sheets are not exposed to the exterior when the movable contacts are affixed to the first sheet, so that there is no fear of adhesion of dust or the like to the adhesive surfaces and hence it is possible to prevent the occurrence of an incomplete state of contact.

Further, since through holes a re formed in the separator sheet opposedly to the plural receptacle holes formed in the second sheet and a protective sheet is affixed to the lower surface of the separator sheet to close the through holes, it is possible to prevent corrosion caused by gases contained in air and also prevent the adhesion of foreign matters, during storage or transport.

Further, since the sheet with movable contacts comprising the first sheet and the second sheet affixed to the lower surface of the first sheet and having plural receptacle holes for receiving domed movable contacts therein, with connecting slots for connecting adjacent receptacle holes with each other being formed in the second sheet, is affixed onto a circuit board having fixed contacts through the adhesive applied to the lower surface of the second sheet, the air present in the dome of each domed movable contact can escape into the next receptacle hole through the associated connecting slot and therefore the movable contact can surely be inverted within the associated receptacle hole, thus affording a good operation feeling. Additionally, also when any of the movable contacts located near the outer periphery of the sheet switch is depressed, it is possible to prevent floating of the sheet and hence possible to prevent the entry of dust.

What is claimed is:

1. A method of manufacturing a sheet switch, the sheet switch comprising:

a first insulating sheet having an adhesive on a lower surface thereof;

a plurality of domed, metallic, movable contacts having upper surfaces affixed to and covered by the adhesive lower surface of the first sheet;

a second insulating sheet affixed to the lower surface of the first sheet and having an adhesive on a lower surface thereof, a plurality of receptacle holes that individually receive the movable contacts and slots that connect adjacent receptacle holes and release air;

a separator sheet removably adhered to the lower surface of the second sheet and having an outer shape larger than the second sheet, through holes and slots having the same shape as and positioned with corresponding receptacle holes of the second sheet; and a protective sheet having an adhesive on an upper surface thereof and affixed to a lower surface of the separator sheet and covering the movable contacts stored in the receptacle and through holes;

the method comprising:

releasing a first combination of the separator sheet and protective sheet from a second combination of the first sheet, movable contacts, and second sheet and exposing the adhesive on the lower surface of the second sheet;

positioning the movable contacts over fixed contacts of a circuit board;

adhering the second combination to the circuit board with the adhesive on the lower surface of the second sheet such that each of the movable contacts opposes one of the fixed contacts.

2. A method of manufacturing a sheet switch comprising:

applying an adhesive to a lower surface of a first insulating sheet;

applying an adhesive to a lower surface of a second insulating sheet;

positioning a separator sheet having an outer shape larger than the second insulating sheet under the second sheet;

removably adhering the separator sheet to the adhesive lower surface of the second insulating sheet;

forming a plurality of slot-connected receptacle holes in the second insulating sheet and forming same-sized slot-connected through holes of the separator sheet in the separator sheet;

affixing the adhesive lower surface of the first insulating sheet to the second insulating sheet;

positioning a plurality of domed, metallic, movable contacts under the plurality of slot-connected through holes of the separator sheet and the plurality of slot-connected receptacle holes of the second insulating sheet;

inserting the movable contacts in the plurality of slot-connected through holes of the separator sheet and the plurality of slot-connected receptacle holes of the second insulating sheet;

affixing upper surfaces of the movable contacts to the adhesive surface of the second insulating sheet;

applying an adhesive to an upper surface of a protective sheet;

affixing the protective sheet to a lower surface of the separator sheet and covering the movable contacts stored in the receptacle and through holes;

releasing a first combination of the separator sheet and protective sheet from a second combination of the first sheet, movable contacts, and second sheet and exposing the adhesive on the lower surface of the second sheet;

positioning the movable contacts over fixed contacts of a circuit board;

adhering the second combination to the circuit board with the adhesive on the lower surface of the second sheet such that each of the movable contacts opposes one of the fixed contacts.

* * * * *